US010639894B2

(12) United States Patent
Suzuki

(10) Patent No.: US 10,639,894 B2
(45) Date of Patent: May 5, 2020

(54) LIQUID DROPLET JETTING HEAD

(71) Applicant: BROTHER KOGYO KABUSHIKI KAISHA, Nagoya-shi, Aichi-ken (JP)

(72) Inventor: Shuhei Suzuki, Nagoya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 15/935,388

(22) Filed: Mar. 26, 2018

(65) Prior Publication Data

US 2018/0281405 A1 Oct. 4, 2018

(30) Foreign Application Priority Data

Mar. 30, 2017 (JP) ..... 2017-066817

(51) Int. Cl.
*B41J 2/14* (2006.01)

(52) U.S. Cl.
CPC ..... *B41J 2/1433* (2013.01); *B41J 2/14016* (2013.01); *B41J 2/14201* (2013.01); *B41J 2002/14411* (2013.01); *B41J 2202/20* (2013.01)

(58) Field of Classification Search
CPC ..... B41J 2002/14411
See application file for complete search history.

(56) References Cited

U.S. PATENT DOCUMENTS

2003/0048328 A1* 3/2003 Inamoto ..... B41J 2/1404 347/44
2003/0058305 A1 3/2003 Murakami et al.
2004/0141031 A1 7/2004 Jung et al.
2007/0115318 A1* 5/2007 Nishizaki ..... B41J 2/16508 347/33
2012/0026247 A1* 2/2012 Scheffelin ..... B41J 2/155 347/47
2014/0160203 A1* 6/2014 Kang ..... B41J 2/14 347/47
2015/0258784 A1* 9/2015 Tanaka ..... B41J 2/1433 347/44
2015/0273826 A1* 10/2015 Komatsu ..... B41J 2/1433 347/50

FOREIGN PATENT DOCUMENTS

JP 2003-170595 A 6/2003
JP 2008-221849 A 9/2008
JP 2011-20380 A 2/2011

* cited by examiner

*Primary Examiner* — Shelby L Fidler
(74) *Attorney, Agent, or Firm* — Merchant & Gould P.C.

(57) ABSTRACT

A liquid droplet jetting head includes a channel structure having a jetting port-formed surface in which jetting ports are formed. The jetting port-formed surface includes a jetting port row formed from the jetting ports arranged in one direction and a first groove and a second groove extending in the one direction. A first end of the first groove and a first end of the second groove are positioned on outer edges of the jetting port-formed surface. A second end of the first groove is separated from a second end of the second groove, and the second end of the first groove and the second end of the second groove are positioned between jetting ports at both ends of the jetting port row, in the one direction. The first groove at least partially overlaps with the second groove in the one direction.

8 Claims, 7 Drawing Sheets

LIQUID DROPLET JETTING HEAD

CROSS REFERENCE TO RELATED APPLICATION

The present application claims priority from Japanese Patent Application No. 2017-066817 filed on Mar. 30, 2017, the disclosure of which is incorporated herein by reference in its entirety.

BACKGROUND

Field of the Invention

The present teaching is related to a liquid droplet jetting head configured to jet liquid droplets from jetting ports.

Description of the Related Art

There is known a liquid droplet jetting head in which jetting ports are aligned densely in a predefined direction. When liquid droplets are jetted from the jetting ports of the liquid droplet jetting head, the liquid droplets fly while sucking in air that exists near a surface formed with the jetting ports (hereinafter, referred to as a jetting port-formed surface). This makes the vicinity of the jetting port-formed surface have negative pressure, generating an air current that goes from outer edges to a center of the liquid droplet jetting head along the jetting port-formed surface. The liquid droplets jetted from the jetting ports at both ends in the predefined direction are more susceptible to the influence of the air current. This causes the liquid droplets to deviate or shift from a target position and to land on a position that is close to a center of a row of the jetting ports rather than the target position. This phenomenon is more remarkable as liquid droplets are jetted with higher frequency.

In order to deal with the phenomenon, there is known a liquid droplet jetting head in which kinetic energy of liquid jetted from the jetting ports positioned at both ends of a row of the jetting ports is greater than kinetic energy of liquid jetted from the jetting ports positioned at a center of the row of the jetting ports.

Further, there is known a recording head configured to perform recording on a recording medium by jetting liquid from jetting ports while reciprocating in a direction intersecting with a direction in which the recording medium is conveyed (e.g., Japanese Patent Application Laid-open No. 2011-020380). A jetting port-formed surface of the recording head includes a groove that continuously extends across the recording head in an arrangement direction of the jetting ports (also referred to as a jetting-port-row direction). This reduces the difference in quantities of the air current entering between the recording head and the recording medium, between the movement of the recording head in a going direction and the movement of the recording head in a returning direction.

SUMMARY

The above recording head includes the groove extending across the recording head in the jetting-port-row direction. This results in more air inlets in the jetting port-formed surface than any other recording heads having no groove. In the recording head having the groove, the quantity of the air entering along the jetting port-formed surface would be relatively small, when liquid droplets are jetted with high frequency. This would reduce influence of the air current on the liquid droplets jetted from the jetting ports at both ends of the row of the jetting ports.

Here, the groove passes through the recording head in the jetting-port-row direction. This causes the air entering through both ends of the groove to collide with each other at a place between the both ends of the groove in the jetting-port-row direction. In that situation, when the force of air current entering through one of the ends is equal to the force of air current entering through the other end, the directions of the two air currents can be considered to be converted in a direction perpendicular to the jetting port-formed surface. Thus, the liquid droplets jetted from the jetting ports in the vicinity of the place where the two air currents collide with each other can be considered to fly in the direction perpendicular to the jetting port-formed surface without being influenced by the air currents in the jetting-port-row direction. However, when the force of air current entering through one of the ends is greater than the force of air current entering through the other end, the directions of the two air currents may not be converted into the direction perpendicular to the jetting port-formed surface at the place where the two air currents collide with each other. This could leave a component of the air current entering through one of the ends. In that case, the liquid droplets jetted from the jetting ports in the vicinity of the place where the two air currents collide with each other could fly while shifting toward the other end side relative to the direction perpendicular to the jetting port-formed surface and land on a position shifted toward the other end.

The present teaching has been made in view of the above problems, and an object of the present teaching is to provide a liquid droplet jetting head that can reduce a shift or deviation of landing positions of liquid droplets jetted from jetting ports positioned at both ends in an arrangement direction of the jetting ports (also referred to as a jetting-port-row direction) and jetting ports positioned between the both ends in the jetting-port-row direction.

According to a first aspect of the present teaching, there is provided a liquid droplet jetting head, including a channel structure having a jetting port-formed surface in which jetting ports are formed, wherein the jetting port-formed surface includes a jetting port row formed from the jetting ports arranged in one direction and a first groove and a second groove extending in the one direction, a first end of the first groove and a first end of the second groove are positioned on outer edges of the jetting port-formed surface, a second end of the first groove is separated from a second end of the second groove, and the second end of the first groove and the second end of the second groove are positioned between jetting ports at both ends of the jetting port row, in the one direction, and the first groove at least partially overlaps with the second groove in the one direction.

According to a second aspect of the present teaching, there is provided a liquid droplet jetting head, including a channel structure having a jetting port-formed surface in which jetting ports are formed, wherein the jetting port-formed surface includes a jetting port row formed from the jetting ports arranged in one direction and a first groove and a second groove extending in the one direction, a first end of the first groove and a first end of the second groove respectively communicate with through holes passing through the channel structure in a direction orthogonal to the jetting port-formed surface at a position inside outer edges of the jetting port-formed surface, a second end of the first groove is separated from a second end of the second groove and the second end of the first groove and the second end of the second groove are positioned between jetting ports at both ends of the jetting port row, in the one direction, and the first groove at least partially overlaps with the second groove in the one direction.

According to the first and second aspects of the present teaching, when the vicinity of the jetting port-formed surface has negative pressure by jetting ink droplets with high frequency, air enters not only from the first groove and the second groove but also from the through holes. This relatively reduces the quantity of the air entering along the jetting port-formed surface, which reduces the influence of an air current on ink droplets jetted from the jetting ports at both ends of the jetting port row.

The second end of the first groove is separated from the second end of the second groove. The air current in the first groove is converted into a direction perpendicular to the jetting port-formed surface at the second end of the first groove. The air current in the second groove is converted into the direction perpendicular to the jetting port-formed surface at the second end of the second groove. Thus, even when the force of the air current in the first groove is different from the force of the air current in the second groove, there is no possibility that the air current in the first groove collides with the air current in the second groove to leave a component in an arrangement direction of the jetting ports (also referred to as a jetting-port-row direction) and that landing positions of the ink droplets jetted from the jetting ports in the vicinity of the collision point deviate in the jetting-port-row direction. Namely, there is no possibility that the landing positions of the ink droplets jetted from the jetting ports positioned at the inside of the jetting port row deviate in the jetting-port-row direction due to the influence of the air current.

The liquid droplet jetting head of the present teaching can reduce the deviation of the landing positions of the liquid droplets that are jetted from the jetting ports positioned at both ends in the jetting-port-row direction and the jetting ports positioned between the both ends in the jetting port row direction.

DESCRIPTION OF THE EMBODIMENTS

An ink-jet head according to an embodiment of the present teaching is described below with reference to the drawings. The embodiment described below is merely an example of the present teaching and it is possible to make any appropriate change(s) in the embodiment of the present teaching without departing from the gist and/or scope of the present teaching.

Figure 1:
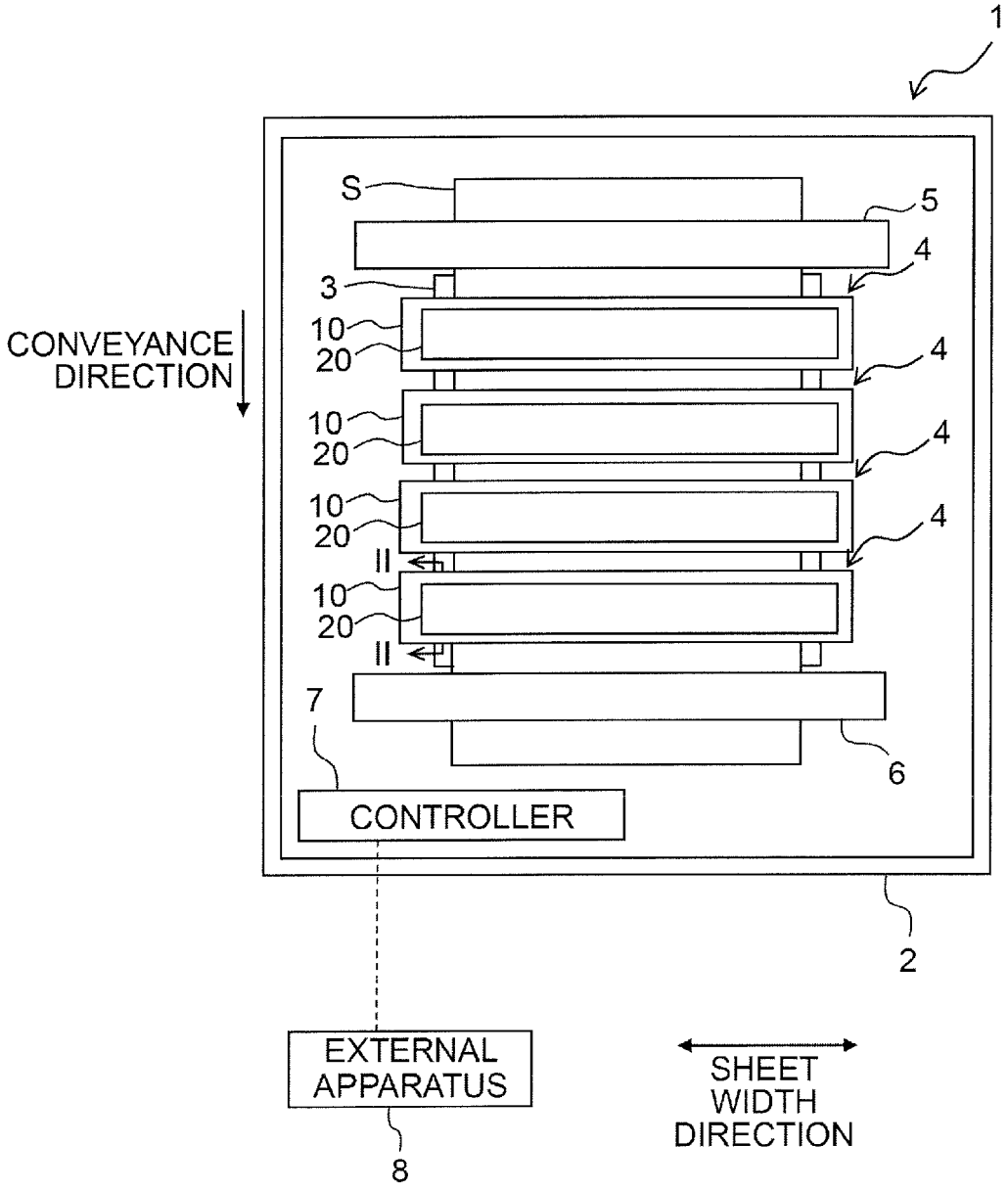
FIG. 1 is a schematic plan view depicting a configuration of a printing apparatus.

As depicted in FIG. 1, a printing apparatus 1 mainly includes a casing 2, a platen 3, four ink-jet heads 4 (an exemplary liquid droplet jetting head), two conveyance rollers 5 and 6, and a controller 7.

The platen 3 is placed in the casing 2. The four ink-jet heads 4 are arranged in a conveyance direction of a recording sheet S to face the platen 3. Four colors of inks (cyan (C), magenta (M), yellow (Y), and black (K)) are supplied from unillustrated ink tanks to the four ink-jet heads 4, respectively. Each of the ink-jet heads 4 jets ink droplets corresponding to one of the four colors. Each of the ink-jet heads 4 is a so-called line-type ink-jet head that is long in a sheet width direction orthogonal to the conveyance direction. The two conveyance rollers 5 and 6 are arranged to sandwich the platen 3 in the conveyance direction. The two conveyance rollers 5 and 6 are driven by a motor (not depicted) to convey the recording sheet S on the platen 3 in the conveyance direction. The controller 7 is connected to an external apparatus 8, such as a PC, by cable or radio. The controller 7 controls respective parts of the printing apparatus 1 based on printing data transmitted from the external apparatus 8.

For example, the controller 7 drives the conveyance rollers 5 and 6 by controlling the motor. This conveys the recording sheet S in the conveyance direction. The controller 7 controls each ink-jet head 4 to jet the corresponding ink in a state where the recording sheet S is placed on the platen 3. This prints an image on the recording sheet S.

Figure 2:
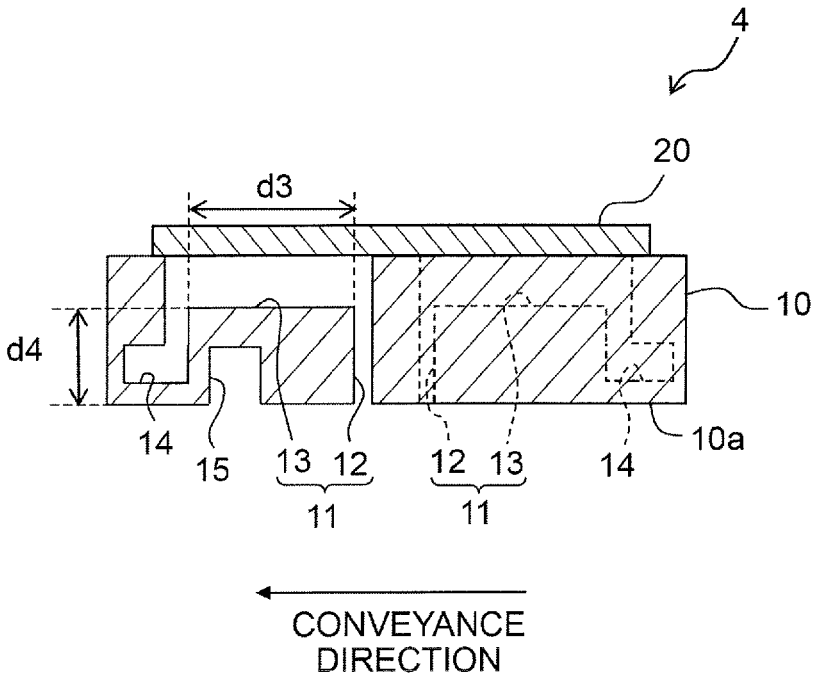
FIG. 2 is a cross-sectional view taken along a line II-II in FIG. 1.

As depicted in FIGS. 1 and 2, each ink-jet head 4 includes a channel structure 10 and an actuator assembly 20. As depicted in FIG. 2, the channel structure 10 includes ink channels 11. Each ink channel 11 includes a jetting port 12 formed in a bottom surface of the channel structure 10 and a pressure chamber 13 communicating with the jetting port 12. Each pressure chamber 13 has a rectangular shape that is long in the conveyance direction. At an end on the side opposite to the jetting port 11, each pressure chamber 13 communicates with a reservoir 14 holding the ink to be supplied to each ink channel 11. The actuator assembly 20 includes actuators respectively corresponding to the ink channels 11. Each actuator includes, for example, a piezo element or a thermal resistor. Each actuator is electrically connected to the controller 7 to apply jetting energy to the ink in the pressure chamber 13 of the ink channel 11 corresponding thereto. Since the structure of the actuator assembly 20 and the structure of the actuator are well known, any detailed explanation therefor is omitted.

Figure 3:
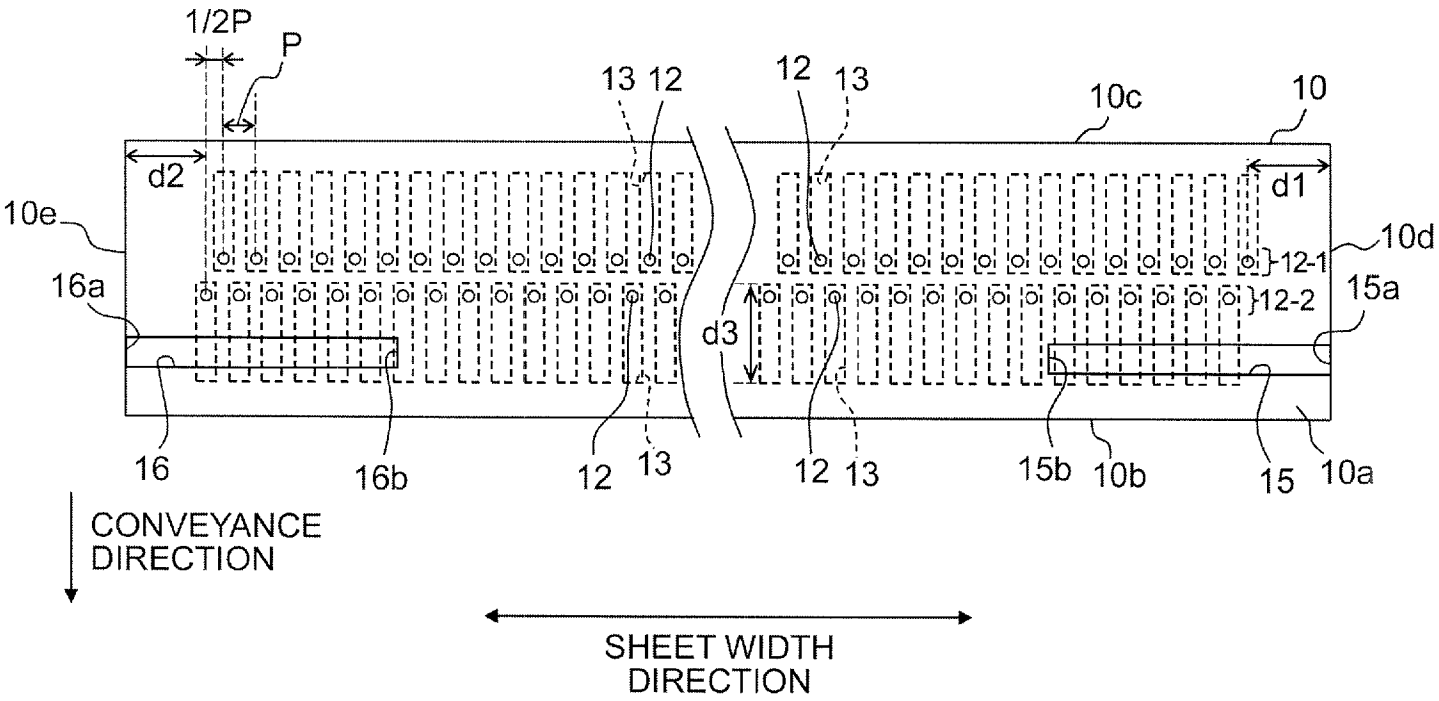
FIG. 3 is a bottom view of a channel structure forming an ink-jet head according to an embodiment of the present teaching.

The bottom surface of the channel structure 10 is referred to as a jetting port-formed surface 10*a*. As depicted in FIG. 3, the jetting port-formed surface 10*a* has a rectangular shape that is long in the sheet width direction (an exemplary one direction). The jetting port-formed surface 10*a* includes two jetting port rows 12-1 and 12-2 that are arranged in the conveyance direction. The jetting ports 12 arranged in a longitudinal direction of the jetting port-formed surface 10*a* at intervals P form each of the jetting port rows 12-1 and 12-2. The jetting port row 12-1 is shifted from the jetting port row 12-2 in the longitudinal direction of the jetting port-formed surface 10*a* by a half of the interval P (½P). In this embodiment, the two jetting port rows 12-1 and 12-2 are formed in the jetting port-formed surface 10*a*. The present teaching, however, is not limited thereto. One jetting port row or three or more of jetting port rows may be formed in the jetting port-formed surface 10*a*.

In the jetting port-formed surface 10*a*, a first groove 15 and a second groove 16 are formed on a side of a first long side 10*b* relative to the two jetting port rows 12-1 and 12-2. Namely, the first groove 15 and the second groove 16 are partially positioned between the jetting port row 12-2 and the first long side 10*b*. In this embodiment, the first groove 15 and the second groove 16 have the same width and the same position in the conveyance direction. Namely, the first groove 15 overlaps completely with the second groove 16 when seen from a first short side 10*d* of the jetting port-formed surface 10*a* in the longitudinal direction of the jetting port-formed surface 10*a*. However, the first groove 15 may be slightly shifted from the second groove 16 in the conveyance direction, provided that they overlap at least partially with each other in the sheet width direction. Namely, the first groove 15 at least partially overlaps with the second groove 16 when seen from the first short side 10*d* in the longitudinal direction of the jetting port-formed surface 10*a*. The first groove 15 extends from the first short side 10*d* of the jetting port-formed surface 10*a* in the longitudinal direction of the jetting port-formed short surface 10*a*. The second groove 16 extends from a second short side 10*e* of the jetting port-formed surface 10*a* in the longitudinal direction of the jetting port-formed surface 10*a*. Namely, a first end 15*a* of the first groove 15 is positioned on the first short side 10*d* of the jetting port-formed surface 10*a*. A first end 16*a* of the second groove 16 is positioned on the second short side 10*e* of the jetting port-formed surface 10*a*. A second end 15*b* of the first groove 15 is separated from a second end 16*b* of the second groove 16, and the first groove 15 does not communicate with the second groove 16. In the longitudinal direction of the jetting port-formed surface 10*a*, the second end 15*b* of the first groove 15 and the second end 16*b* of the second groove 16 are positioned between the jetting port 12 closest to the first short side 10*d* and the jetting port 12 closest to the second short side 10*e*.

The length of the first groove 15 in the sheet width direction is only required to be a length that is equal to or more than a distance d1 from the first short side 10*d* of the jetting port-formed surface 10*a* to the jetting port 12 closest to the first short side 10*d* (an exemplary first jetting port). The length of the second groove 16 in the sheet width direction is only required to be a length that is equal to or more than a distance d2 from the second short side 10*e* of the jetting port-formed surface 10*a* to the jetting port 12 closest to the short side 10*e* (an exemplary second jetting port). The width of the first groove 15 and the second groove 16 is only required to be a width that is equal to or less than a length d3, of a bottom surface forming a part of the pressure chamber 13, in the conveyance direction. The depth of the first groove 15 and the second groove 16 is only required to be a depth that is smaller than a distance d4 from the jetting port-formed surface 10*a* to the bottom surface of the pressure chamber 13. The length of the first groove 15 in the sheet width direction may be different from the length of the second groove 16 in the sheet width direction. The width of the first groove 15 may be different from the width of the second groove 16. The depth of the first groove 15 may be different from the depth of the second groove 16.

In the ink-jet head 4 of this embodiment, the jetting port-formed surface 10*a* includes the first groove 15 and the second groove 16 wherein the first groove 15 extends from the first short side 10*d* of the jetting port-formed surface 10*a* and the second groove 16 extends from the second short side 10*e* of the jetting port-formed surface 10*a*. In that configuration, when the vicinity of the jetting port-formed surface 10*a* has negative pressure by jetting ink droplets with high frequency, air enters through both the first groove 15 and the second groove 16. This makes the quantity of the air entering along the jetting port-formed surface 10*a* smaller than a configuration in which neither the first groove 15 nor the second groove 16 are formed. Thus, the first groove 15 and the second groove 16 reduce the influence of the air current on the ink droplets jetted from the jetting ports 12 at both ends of the jetting port rows 12-1 and 12-2.

The second end 15*b* of the first groove 15 is separated from the second end 16*b* of the second groove 16 and the first groove 15 does not communicate with the second groove 16. In that configuration, the air current in the first groove 15 does not collide with the air current in the second groove 16. Namely, the air current in the first groove 15 is converted in a direction perpendicular to the jetting port-formed surface 10*a* at the second end 15*b* of the first groove 15, and the air current in the second groove 16 is converted in the direction perpendicular to the jetting port-formed surface 10*a* at the second end 16*b* of the second groove 16. In that configuration, if the force of air current in the first groove 15 is different from the force of air current in the second groove 16, the air current in the first groove 15 would not collide with the air current in the second groove 16. Thus, there is no possibility that the two air currents collide with each other to leave a component in an arrangement direction of the jetting ports (also referred to as a jetting-port-row direction) and that the landing positions of ink droplets jetted from the jetting ports 12 in the vicinity of the place where the air currents collide with each other shift in the jetting-port-row direction. Namely, there is no possibility that the ink droplets jetted from the jetting ports 12 positioned at the inside of each of the jetting port rows 12-1 and 12-2 in the jetting-port-row direction are influenced by the air currents to land on positions shifted in the jetting-port-row direction.

The first groove 15 at least has the distance d1 from the first short side 10*d* of the jetting port-formed surface 10*a* to the jetting port 12 closest to the first short side 10*d*. Further, the second groove 16 at least has the distance d2 from the second short side 10*e* of the jetting port-formed surface 10*a* to the jetting port 12 closest to the second short side 10*e*. Thus, it is possible to reduce at least the influence of the air currents on the ink droplets jetted from the jetting ports 12 at both ends of the jetting port rows 12-1 and 12-2.

In this embodiment, the jetting port-formed surface 10*a* includes the first groove 15 and the second groove 16 on the side of the first long side 10*b* relative to the two jetting port rows 12-1 and 12-2. The jetting port-formed surface 10*a*, however, may include the first groove 15 and the second groove 16 on a side of a second long side 10*c*. In other words, the first groove 15 and the second groove 16 may be partially positioned between the jetting port row 12-1 and the second long side 10*c*. Or, the first groove 15 and the second groove 16 may be positioned between the jetting port row 12-1 and the jetting port row 12-2 (a first modified example). In the configuration of the first modified example, the width of the first groove 15 and the second groove 16 is only required to be narrower than an interval between the two jetting port rows 12-1 and 12-2. Such a configuration can obtain effects similar to those of the above embodiment.

Figure 4:
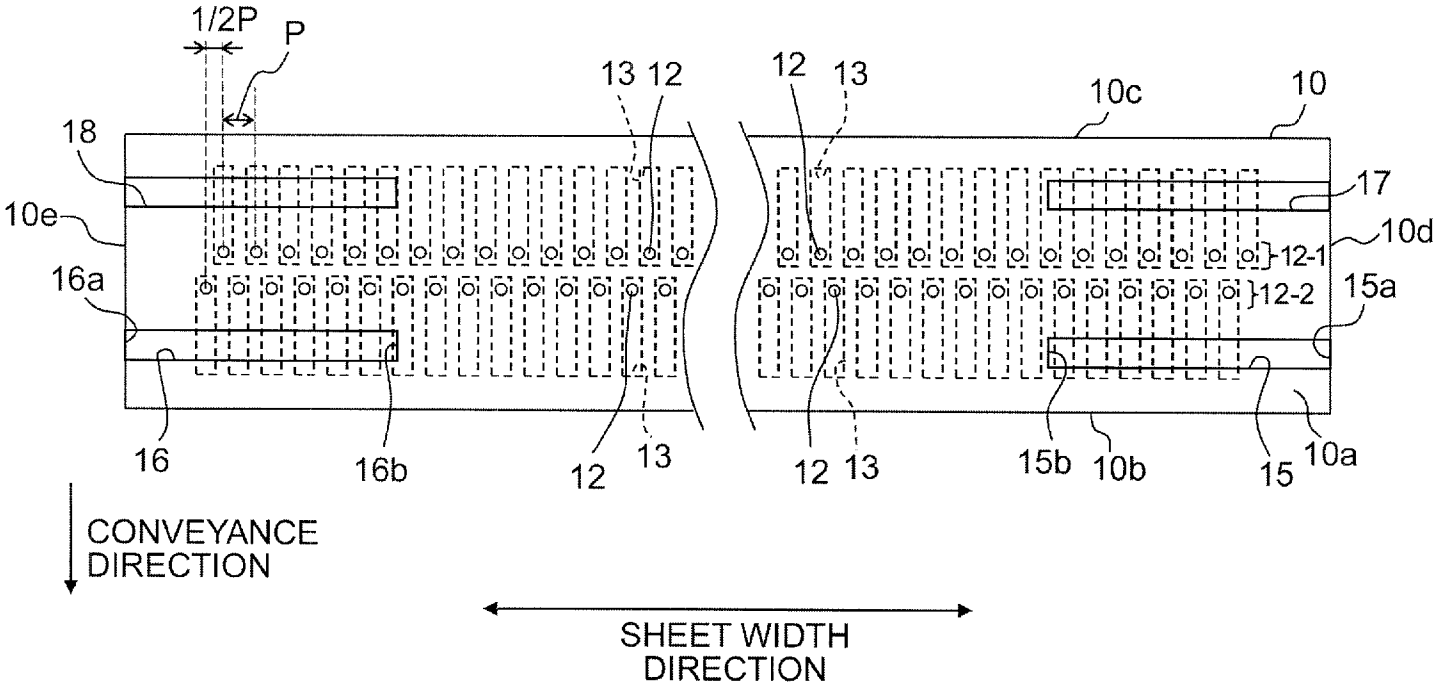
FIG. 4 is a bottom view of a channel structure according to a second modified example of the present teaching.

Alternatively, as depicted in FIG. 4, a third groove 17 and a fourth groove 18 may be formed such that the grooves 17, 18 and the grooves 15, 16 are symmetric with respect to the two jetting port rows 12-1 and 12-2 (a second modified example). In that configuration, the third groove 17 preferably has the same structure as that of the first groove 15, and the fourth groove 18 preferably has the same structure as that of the second groove 16. With such structure, air enters not only through the first groove 15 and the second groove 16 but also through the third groove 17 and the fourth groove 18 when the vicinity of the jetting port-formed surface 10*a* has negative pressure by jetting ink droplets with high frequency. This further reduces the quantity of the air entering along the jetting port-formed surface 10*a*. Accordingly, providing the third and fourth grooves 17 and 18 in addition to the first and second grooves 15 and 16 further reduces the influence of the air currents on the ink droplets jetted from the jetting ports 12 at both ends of the jetting port rows 12-1 and 12-2.

Figure 5:
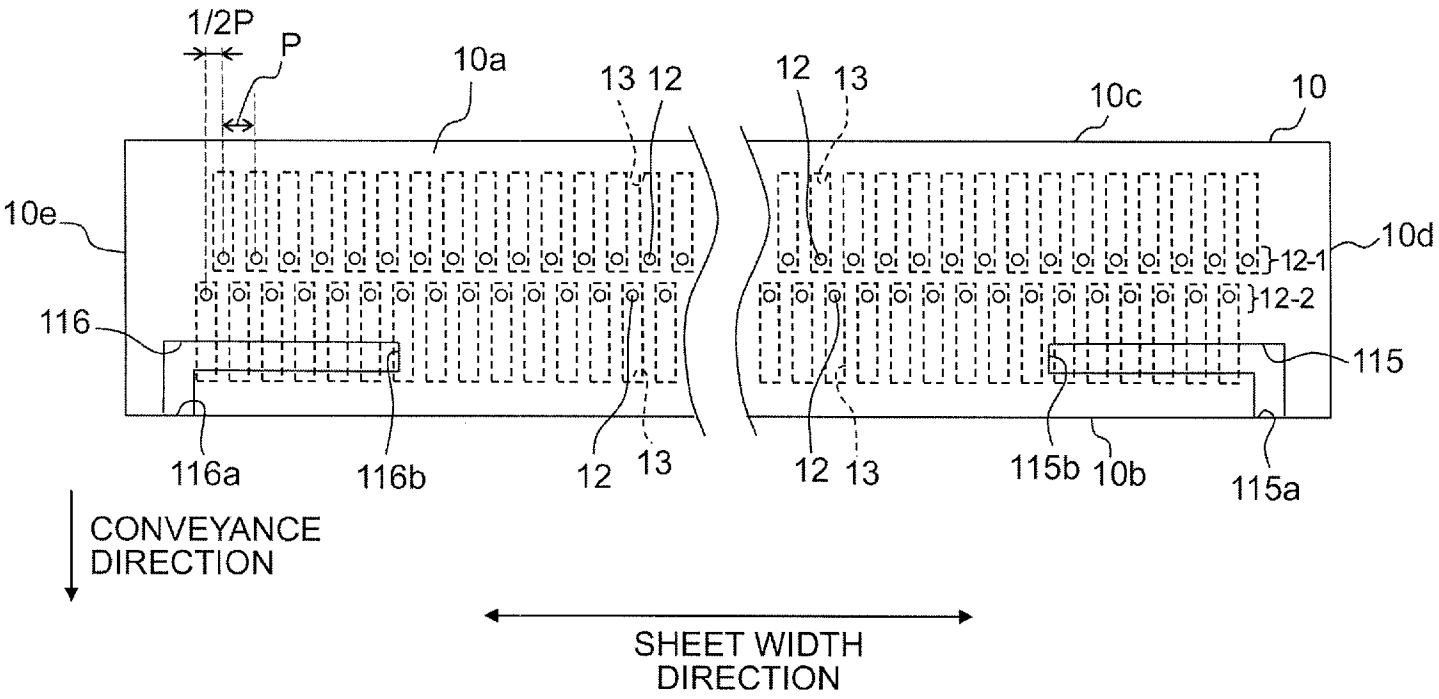
FIG. 5 is a bottom view of a channel structure according to a third modified example of the present teaching.

In the above embodiment, the first groove 15 extends from the first short side 10*d* of the jetting port-formed surface 10*a* in the sheet width direction and the second groove 16 extends from the second short side 10*e* of the jetting port-formed surface 10*a* in the sheet width direction. The present teaching, however, is not limited thereto. For example, as depicted in FIG. 5, a first groove 115 may extend from the first long side 10*b* of the jetting port-formed surface 10*a* in a lateral direction of the jetting port-formed surface 10*a*, turn to the longitudinal direction of the jetting port-formed surface 10*a* before the jetting port row 12-2, and extend along the jetting port row 12-2. Similarly, a second groove 116 may extend from the first long side 10*b* of the jetting port-formed surface 10*a* in the lateral direction of the jetting port-formed surface 10*a*, turn to the longitudinal direction of the jetting port-formed surface 10*a* before the jetting port row 12-2, and extend along the jetting port row 12-2 (a third modified example). Namely, a first end 115*a* of the first groove 115 and a first end 116*a* of the second groove 116 may be positioned on the first long side 10*b* of the jetting port-formed surface 10*a*. Also in the third modified example, a second end 115*b* of the first groove 115 is separated from a second end 116*b* of the second groove 116 and the first groove 115 does not communicate with the second groove 116. The configuration of the third modified example can obtain effects similar to those of the above embodiment.

In the above embodiment, the depth of the first groove 15 and the second groove 16 is fixed. The depth of the first groove 15 and the second groove 16, however, may vary in the sheet width direction. Namely, the depth of the first groove 15 may be smaller from the first end 15*a* toward the second end 15*b*. Similarly, the depth of the second groove 16 may be smaller from the first end 16*a* toward the second end 16*b* (a fourth modified example). In that configuration, at the second end 15*b* of the first groove 15 and the second end 16*b* of the second groove 16, the air currents in the first groove 15 and the second groove 16 are allowed to reliably escape in the direction perpendicular to the jetting port-formed surface 10*a*.

Figure 6:
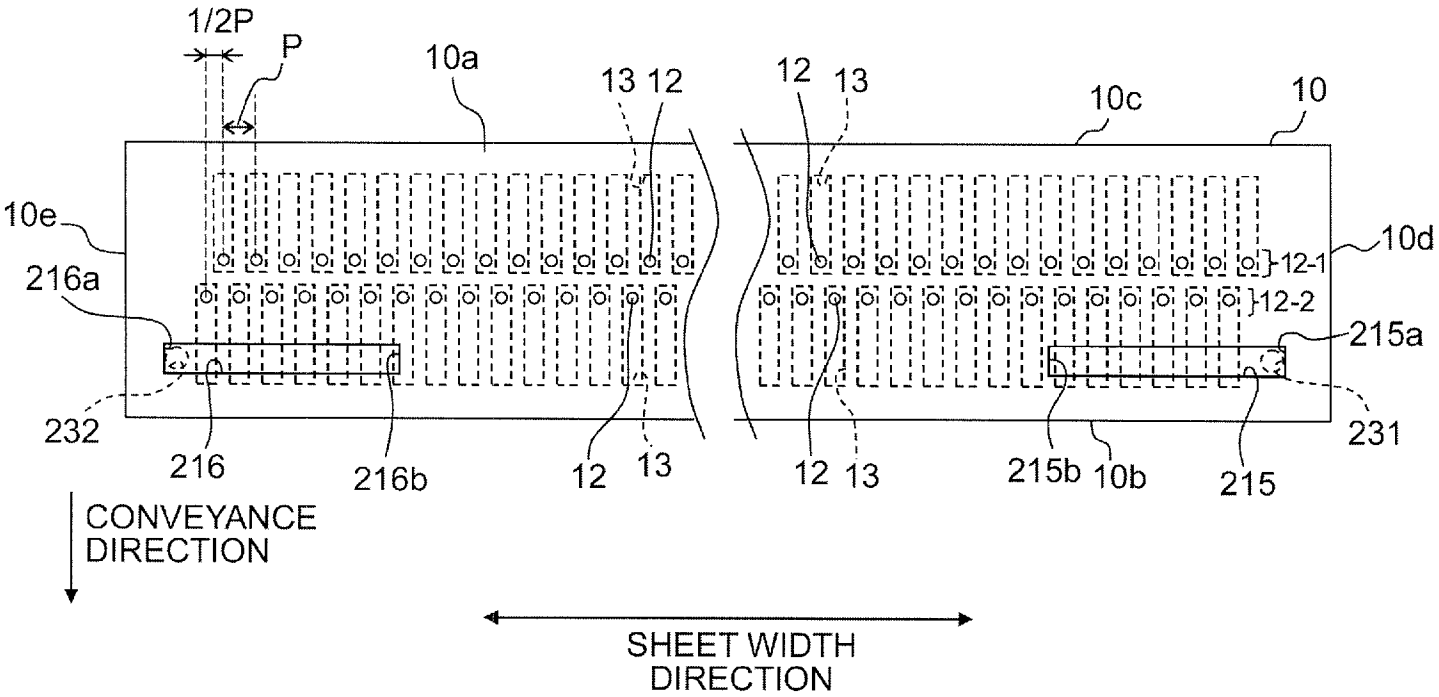
FIG. 6 is a bottom view of a channel structure according to a fifth modified example of the present teaching.

In the embodiment and the above described modified examples, the first end 15*a* (115*a*) of the first groove 15 (115) and the first end 16*a* (116*a*) of the second groove 16 (116) are positioned on the short sides of the jetting port-formed surface 10*a* (the long sides of the jetting port-formed surface 10*a*). Namely, they are positioned on outer edges of the jetting port-formed surface 10*a*. The present teaching, however, is not limited thereto. For example, as depicted in FIG. 6, a first end 215*a* of a first groove 215 may communicate with a through hole 231 passing through the channel structure 10 in the direction perpendicular to the jetting port-formed surface 10*a* at a position inside an outer edge of the jetting port-formed surface 10*a*. Similarly, a first end 216*a* of a second groove 216 may communicate with a through hole 232 passing through the channel structure 10 in the direction perpendicular to the jetting port-formed surface 10*a* at a position inside an outer edge of the jetting port-formed surface 10*a* (a fifth modified example). In that configuration, when the vicinity of the jetting port-formed surface 10*a* has negative pressure by jetting ink droplets with high frequency, air enters the first and second grooves 215 and 216 through the through holes 231 and 232. This reduces the quantity of the air entering along the jetting port-formed surface 10*a*. Also in the fifth modified example, a second end 215*b* of the first groove 215 is separated from a second end 216*b* of the second groove 216 and the first groove 215 does not communicate with the second groove 216. The configuration of the fifth modified example can obtain effects similar to those of the above embodiment.

Figure 7:
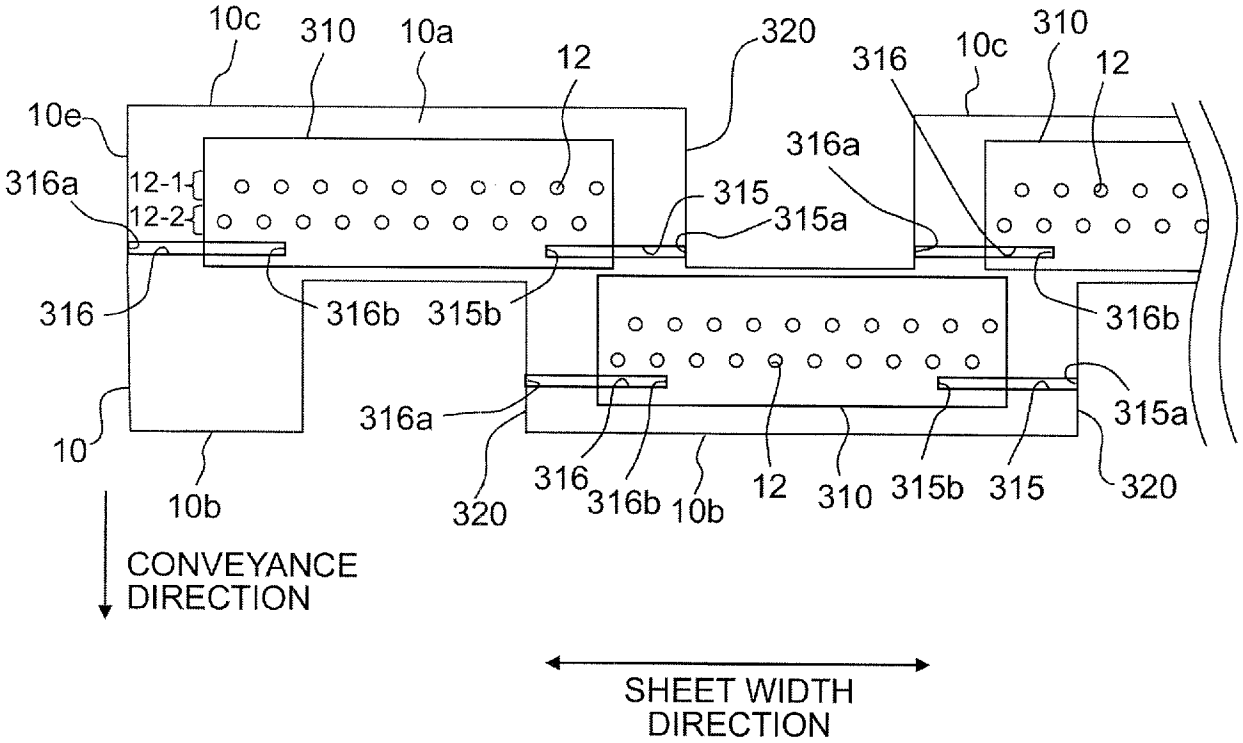
FIG. 7 is a bottom view of a channel structure according to a sixth modified example of the present teaching.

As depicted in FIG. 7, the channel structure 10 of the ink-jet head 4 according to the above embodiment may be configured such that head chips 310 are arranged zigzag in the sheet width direction (a sixth modified example). In this modified example, a bottom surface of each head chip 310 includes jetting ports 12 that form two jetting port rows 12-1 and 12-2 arranged in the conveyance direction. The two jetting port rows 12-1 and 12-2 extend in the sheet width direction. The bottom surface of each head chip 310 is flush with the bottom surface of the channel structure 10, so that the bottom surface of each head chip 310 and the bottom surface of the channel structure 10 form the jetting port-formed surface 10*a*. The long sides 10*b* and 10*c* of the jetting port-formed surface 10*a* include notches 320 that face the head chips 310 in the conveyance direction. The bottom surface of each head chip 310 includes a first groove 315 and a second groove 316 extending in the sheet width direction.

For example, in the head chip 310 closest to the short side 10*e* of the jetting port-formed surface 10*a*, the first groove 315 extends from the notch 320 adjacent thereto in the sheet width direction, and the second groove 316 extends from the short side 10*e* of the jetting port-formed surface 10*a*. In the head chip 310 second closest to the short side 10*e*, the first groove 315 extends from the notch 320 on a first side in the sheet width direction (the notch 320 second closest to the short side 10*e* among the notches 320 positioned on the long side 10*b*). Further, in the head chip 310 second closest to the short side 10*e*, the second groove 316 extends from the notch 320 on a second side in the sheet width direction (the notch 320 closest to the short side 10*e* among the notches 320 positioned on the long side 10*b*). Namely, both in the head chip 310 placed at the outermost position in the sheet width direction and the head chip 310 placed at an inside position in the sheet width direction, a first end 315*a* of each first groove 315 and a first end 316*a* of each second groove 316 are positioned on the outer edges of the jetting port-formed surface 10*a*.

In that configuration, when the vicinity of the bottom surface of each head chip 310 has negative pressure by jetting ink droplets from each head chip 310 with high frequency, air enters the first groove 315 and the second groove 316. This reduces the quantity of the air entering along the bottom surface of each head chip 310. Also in the sixth modified example, a second end 315*b* of the first groove 315 is separated from a second end 316*b* of the second groove 316 and the first groove 315 does not communicate with the second groove 316. The configuration of the sixth modified example can obtain effects similar to those of the above embodiment.

In the above description, the embodiment and the modified examples of the line-type ink-jet head are explained. The liquid jetting apparatus of the present teaching may be a serial-type ink-jet head. The serial-type ink-jet head includes jetting ports arranged in the conveyance direction, and jets ink droplets from each jetting port on a recording sheet while moving in the sheet width direction by use of a movement mechanism. After the recording sheet is conveyed in the conveyance direction by a predefined amount, the ink-jet head again jets ink droplets from each jetting port while moving in the sheet width direction.

In typical serial-type ink-jet heads, a jetting port-formed surface has no groove. Thus, when ink droplets are jetted with high frequency, the landing positions of ink droplets jetted from the jetting ports, of multiple jetting ports, positioned at both ends in the conveyance direction may shift. Namely, during the first movement of the ink-jet head in the sheet width direction, the landing positions of ink droplets jetted from the jetting ports positioned at the most upstream side in the conveyance direction may shift toward the downstream side in the conveyance direction. Further, during the second movement of the ink-jet head in the sheet width direction, the landing positions of ink droplets jetted from the jetting ports positioned at the most downstream side in the conveyance direction may shift toward the upstream side in the conveyance direction. This forms a discontinuous portion in the conveyance direction called a white streak or stripe between an image formed by the first movement of the ink-jet head in the sheet width direction and an image formed by the second movement of the ink-jet head in the sheet with direction.

In the serial-type ink-jet head according to the present teaching, the jetting port-formed surface has the grooves. This reduces the shifts of ink droplets at end positions and formation of the white streak, when the ink droplets are jetted with high frequency.

What is claimed is:

1. A liquid droplet jetting head, comprising a channel structure having a jetting port-formed surface in which jetting ports are formed, wherein the jetting port-formed surface includes a jetting port row formed from the jetting ports arranged parallel to one direction, a first groove extending parallel to the one direction, and a second groove extending parallel to the one direction, a first end of the first groove and a first end of the second groove are positioned on outer edges of the jetting port-formed surface, a second end of the first groove is separated from a second end of the second groove, and the second end of the first groove and the second end of the second groove are positioned between jetting ports at both ends of the jetting port row, in the one direction, and the first groove at least partially overlaps with the second groove in the one direction.

2. The liquid droplet jetting head according to claim 1, wherein the jetting port-formed surface has a rectangular shape which is long in the one direction, the first end of the first groove is positioned on a first short side of the jetting port-formed surface, the first end of the second groove is positioned on a second short side of the jetting port-formed surface, and the first groove and the second groove are formed on a side of a first long side of the jetting port-formed surface relative to the jetting port row.

3. The liquid droplet jetting head according to claim 2, wherein the jetting port-formed surface further includes a third groove and a fourth groove extending parallel to the one direction, a first end of the third groove is positioned on the first short side of the jetting port-formed surface, a first end of the fourth groove is positioned on the second short side of the jetting port-formed surface, a second end of the third groove is separated from a second end of the fourth groove, and the third groove and the fourth groove are formed on a side of a second long side of the jetting port-formed surface relative to the jetting port row.

4. The liquid droplet jetting head according to claim 2, wherein the jetting port row includes a first jetting port closest to the first short side of the jetting port-formed surface and a second jetting port closest to the second short side of the jetting port-formed surface, a length of the first groove in the one direction is equal to or more than a distance from the first short side to the first jetting port, and a length of the second groove in the one direction is equal to or more than a distance from the second short side to the second jetting port.

5. The liquid droplet jetting head according to claim 1, wherein the channel structure further includes pressure chambers communicating with the jetting ports respectively, each of the pressure chambers extends in a direction orthogonal to the one direction, and a width of the first groove and a width of the second groove are equal to or less than a length, of a surface of each of the pressure chambers on a side of the jetting port-formed surface, in the direction orthogonal to the one direction.

6. The liquid droplet jetting head according to claim 5, wherein a depth of the first groove and a depth of the second groove are smaller than a distance from the jetting port-formed surface to the surface of each of the pressure chambers on the side of the jetting port-formed surface.

7. The liquid droplet jetting head according to claim 1, wherein a depth of the first groove is decreased from the first end toward the second end, and a depth of the second groove is decreased from the first end toward the second end.

8. The liquid droplet jetting head according to claim 1, wherein the jetting port-formed surface has a rectangular shape which is long in the one direction, a long side of the jetting port-formed surface includes notches which are long in a short side direction of the jetting port-formed surface, and at least one of the first end of the first groove and the first end of the second groove is positioned on any one of the notches.

* * * * *